US009821359B2

(12) United States Patent
Niaraki et al.

(10) Patent No.: US 9,821,359 B2
(45) Date of Patent: Nov. 21, 2017

(54) HIGH-SPEED HYDRAULIC FORMING OF METAL AND NON-METAL SHEETS USING ELECTROMAGNETIC FIELDS

(71) Applicants: Rasoul Jelokhani Niaraki, Qazvin (IR); Mehdi Soltanpour, Karaj (IR); Ali Fazli, Qazvin (IR)

(72) Inventors: Rasoul Jelokhani Niaraki, Qazvin (IR); Mehdi Soltanpour, Karaj (IR); Ali Fazli, Qazvin (IR)

( * ) Notice: Subject to any disclaimer, the term of this patent is extended or adjusted under 35 U.S.C. 154(b) by 0 days.

(21) Appl. No.: 15/379,404

(22) Filed: Dec. 14, 2016

(65) Prior Publication Data

US 2017/0095855 A1 Apr. 6, 2017

(30) Foreign Application Priority Data

Dec. 14, 2015 (IR) ..... 13945014000301041

(51) Int. Cl.
*B21D 26/12* (2006.01)
*B21D 26/14* (2006.01)
*B30B 1/42* (2006.01)

(52) U.S. Cl.
CPC ..... *B21D 26/14* (2013.01); *B21D 26/12* (2013.01); *B30B 1/42* (2013.01)

(58) Field of Classification Search
CPC ..... B21D 26/12; B21D 26/14; B30B 1/42
USPC ..... 72/57
See application file for complete search history.

(56) References Cited

U.S. PATENT DOCUMENTS 2,983,242 A 5/1961 Cole
3,783,662 A * 1/1974 Keller ..... B30B 1/42 72/1
3,894,925 A * 7/1975 Inoue ..... B21D 26/12 204/224 M
5,415,021 A 5/1995 Folmer
5,502,996 A * 4/1996 Strong ..... B21J 15/24 29/705
5,813,274 A * 9/1998 Strong ..... B30B 1/42 100/256
6,050,121 A 4/2000 Daehn et al.
6,708,542 B1 3/2004 Gafri et al.
7,389,664 B1 6/2008 Cheng et al.
7,493,787 B2 2/2009 Golovashchenko et al.
7,802,457 B2 9/2010 Golovashchenko et al.
7,954,357 B2 * 6/2011 Bradley ..... B21D 26/14 72/466.8

(Continued)

*Primary Examiner* — David B Jones
(74) *Attorney, Agent, or Firm* — NovoTechIP International PLLC

(57) ABSTRACT

A system and method for hydraulic forming of sheets is provided. A coil is connected to a pulse generator storing electric energy and discharging the electric energy to the coil, creating a first electromagnetic field in the coil. A conductive plate placed on the coil such that the first electromagnetic field causes creating of a second electromagnetic field in the conductive plate, in a direction opposite to the first electromagnetic field, creating a force. A pressure chamber filled with a fluid and placed on the conductive plate. A piston placed inside the pressure chamber to transfer the force to the fluid. A sheet placed on the pressure chamber, the fluid being configured to receive the force from the piston and transfer the force to the sheet. A die placed on the sheet, wherein the force transferred to the sheet from the fluid causes the sheet to take a shape of the die.

20 Claims, 10 Drawing Sheets

(56) References Cited

U.S. PATENT DOCUMENTS 8,127,582 B2 * 3/2012 Johnson-Morke ..... B21D 26/12
29/419.2

* cited by examiner

HIGH-SPEED HYDRAULIC FORMING OF METAL AND NON-METAL SHEETS USING ELECTROMAGNETIC FIELDS

CROSS REFERENCE TO RELATED APPLICATION

This application claims the benefit of priority to an Iran patent application having serial number 139450140003010412 filed on Dec. 14, 2015, which is incorporated by reference herein in its entireties.

TECHNICAL FIELD

The instant application relates generally to formation of metal and non-metal sheets and, more particularly, to high-speed hydraulic forming of sheets using electromagnetic fields.

BACKGROUND

Various industries desire light-weight high strength parts to reduce energy consumption in moving devices by reducing their weights. High strength metals are good candidates for such parts. However, such metals which are typically used in sheet form, have low formability. Therefore, conventional forming methods cannot be used for forming these high strength metals.

Recent studies show that high-speed forming methods can cause an increase in the strain rate of the metal sheets and therefore can increase their formability. High-speed forming methods include, for example, explosive forming, electromagnetic forming and electrohydraulic forming. However, each of the methods have drawbacks. For example, the explosive forming method cannot be automated. The electromagnetic forming requires the metal sheet to have high conductivity and as such the electromagnetic method cannot be applied to non-conductive material.

Therefore, a need exists for a system and method for high-speed forming of metal and non-metal sheets without having to endure the drawbacks of the conventional methods.

SUMMARY

In one general aspect, the instant application describes a system for high-speed forming of metal and non-metal sheets using electromagnetic fields. The system includes a coil connected to a pulse generator configured to store electric energy and suddenly discharge it to the coil thereby creating a first electromagnetic field in the coil, a conductive plate placed on the coil such that the first electromagnetic field causes creating of a second electromagnetic field in the conductive plate, the second electromagnetic field being in a direction opposite to the first electromagnetic field thereby creating a force, a pressure chamber filled with a fluid and placed on the conductive plate, a piston placed inside the pressure chamber and configured to transfer the force to the fluid, the fluid being in contact with the piston on a first side of the fluid, a sheet placed on the pressure chamber on a second side of the fluid, the fluid being configured to receive the force from the piston and transfer the force to the sheet, and a die placed on the sheet, wherein the force transferred to the sheet from the fluid causes the sheet to take a shape of the die.

The above-mentioned and other general aspects may include one or more of the following features. For example, the die may include a port coupled to a vacuum pump configured to remove air inside the die. The piston can be configured to axially move in the pressure chamber toward the fluid. The pressure chamber is connected to a pump such that the pump adjusts a volume of the fluid in the pressure chamber. The pressure chamber includes a port configured to remove air inside the pressure chamber. A rubber plate can be placed between the fluid and the sheet, and an O-ring can be placed between the piston and the pressure chamber, wherein the O-ring is configured to prevent fluid leakage from a gap between the pressure chamber and the piston. An O-ring is placed between the pressure chamber, and the sheet, wherein the O-ring is configured to prevent fluid leakage from a gap between the pressure chamber and the sheet. A circumference of the pressure chamber and a circumference of the die can be grooved to prevent radial displacement of the sheet. The die can be held in place by a press ram. The fluid can be water or oil, and the fluid volume can be adjusted based on a calculated optimal value. The conductive plate can be a thick plate made from a highly conductive metal such as copper or aluminum. An entrance port of the pressure chamber may have a check valve to prevent backflow of the fluid. The system may also include an accumulator for readjusting the fluid, the piston and the conductive plate.

In another general aspect, the instant application describes a method for high-speed forming of metal and non-metal sheets. The method includes filling a pressure chamber with a fluid, placing a material sheet on the pressure chamber, placing a piston inside the pressure chamber, the piston being configured to axially move in the pressure chamber, placing a conductive plate in contact with the piston on a coil, placing a die on the material sheet, pressing the die to the material sheet using a press, removing air from the pressure chamber by moving the fluid and the piston upward using a hydraulic jack, and connecting the coil to a power generator configured to store electric energy and discharge the electric energy to the coil thereby creating a first electromagnetic field in the coil such that the first electromagnetic field causes a second electromagnetic field in the conductive plate, wherein: the second electromagnetic field is in a direction opposite to the first electromagnetic field creating a repelling force there between, the repelling force is transferred by the piston to the fluid and from the fluid to the material sheet, and the repelling force transferred to the material sheet from the fluid causes the material sheet to take a shape of the die.

The above-mentioned and other general aspects may include one or more of the following features. For example, repeatedly adjusting the conductive plate on the flat coil and the piston on the conductive plate and discharging electricity produced by the power generator in the coil, until the material sheet takes a complete shape of the die. The material sheet can be a conductive sheet, a non-conductive sheet, or a combination thereof.

In yet another general aspect, the instant application describes a system for high-speed forming of metal and non-metal sheets using electromagnetic fields. The system includes a coil connected to a power generator configured to store electric energy and discharge the electric energy to the coil thereby creating a first electromagnetic field in the coil, a conductive plate placed on the coil such that the first electromagnetic field causes creating of a second electromagnetic field in the conductive plate, the second electromagnetic field being in a direction opposite to the first electromagnetic field thereby creating a force pushing the conductive plate away from the coil, a pressure chamber filled with a fluid and placed on the conductive plate, a piston placed inside the pressure chamber and in contact with a first side of the fluid and configured to receive the force from the conductive plate and move away from the coil and transfer the force to the fluid, a material sheet placed on the pressure chamber on a second side of the fluid, the fluid being configured to receive the force from the piston and transfer the force to the material sheet, a rubber pad placed between the fluid in the pressure chamber and the material sheet to prevent contact between the fluid and the material sheet, wherein the piston transfers the force to the fluid in the pressure chamber, and the fluid transfers the pressure force to the rubber pad which in turn transfers the force to the material sheet, and a die placed on the sheet, wherein the force transferred to the sheet from the fluid causes the sheet to take a shape of the die.

The above-mentioned and other general aspects may include one or more of the following features. For example, the conductive plate can be a thick plate made from a highly conductive metal such as copper or aluminum. The pressure chamber may have check valve at fluid entrance to prevent backflow of the fluid. The system may further include an accumulator readjusting the fluid, the piston and the conductive plate.

BRIEF DESCRIPTION OF THE DRAWINGS

Features of the subject technology are set forth in the appended claims. However, for purpose of explanation, several implementations of the subject technology are set forth in the following figures.

DETAILED DESCRIPTION

Figure 1:
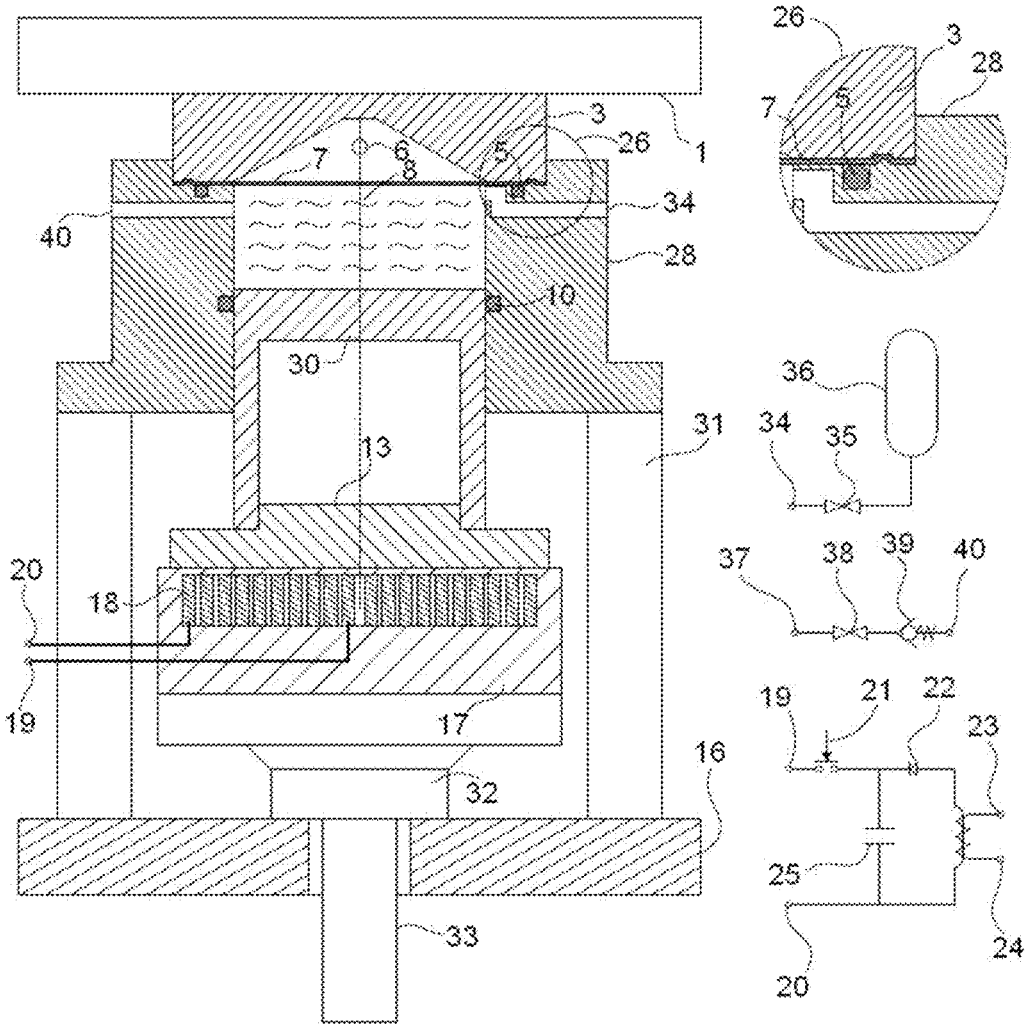
FIG. 1 illustrate a diagram of a system for high-speed hydraulic forming of metal and non-metal sheets using electromagnetic fields, according to one implementation.

In the following detailed description, numerous specific details are set forth by way of examples in order to provide a thorough understanding of the relevant teachings. However, it should be apparent to those skilled in the art that the present teachings may be practiced without such details. In other instances, well-known methods, procedures, components, and/or circuitry have been described at a relatively high-level, without detail, in order to avoid unnecessarily obscuring aspects of the present teachings.

Various industries such as automotive and aerospace industries use light-weight high strength material such as, for example, aluminum alloys and advanced high strength steels to reduce energy consumption and cost. These high strength materials have low formability and special forming method is needed to form sheets of the material into desired shapes. The forming methods used for such high strength materials aim at increasing the strain rate of the material, because increase in strain rate can noticeably increase the formability of the sheets. Various forming methods such as, for example, explosive forming, electromagnetic forming and electrohydraulic forming can increase the strain rate of the material sheets. However, each of the methods has multiple drawbacks.

The process of explosive forming includes placing the material sheet on a fluid filled chamber and placing a die on the sheet. The pressure from the shock wave produced from explosion of an explosive placed inside the fluid creates a shock wave inside the fluid chamber which transfers through the fluid and pushes the sheet toward the die such that the sheet takes the shape of the die.

The process of electromagnetic forming is used for conductive metal sheets such as, for example, copper, aluminum, etc. The electromagnetic forming method includes placing the metal sheet on a flat coil and placing the die on the metal sheet. The electrical current stored in high capacity capacitors is discharged in the flat coil. The electricity discharge can cause a high electric current to flow within the coil and produce an electromagnetic field in the coil. The electromagnetic field can cause a time-varying eddy current within the conductive metal sheet. The eddy current can cause an electromagnetic field in the opposite direction of the coil electromagnetic field. The two opposite electromagnetic fields can produce a repelling force against each other. The repelling force pushes the metal sheet towards the die such that the metal sheet takes the shape of the die.

The process of electrohydraulic forming includes discharging the electricity stored in high capacity capacitors in two electrodes placed in water. The electric energy can evaporate the water between the two electrodes and the pressure from the shock wave produced from the steam can increase rapidly and cause a shock in the fluid (water). The created shock wave is transferred to the sheet through the fluid and the sheet is pushed towards a die and takes the shape of the die.

Each forming method explained above has multiple drawbacks. For example, the explosive forming method cannot be automated. The explosive method requires an explosive storage which can be unsafe and costly. In addition, the energy produced from explosion cannot be easily adjusted and therefore, the forming may not have a high precision.

The electromagnetic forming requires the metal sheet to have high conductivity. The electromagnetic method cannot be applied to non-conductive material. In order to form a non-metal sheet or a low conductive metal using the electromagnetic forming, a secondary sheet (driver sheet) with high conductivity can be used. The driver sheet can be placed under the non-metal or low conductive sheet such that forming of the secondary sheet can force the non-metal or low conductive sheet to form. However, the driver sheet cannot be reused. In addition, in electromagnetic method due to the distance between coil rings the electromagnetic field produced in the coil may not be uniform. Moreover, the electromagnetic forming process cannot be performed in multiple steps. This is because upon the first step of forming process the formed part (from the sheet) is repelled from the coil and the increased distance between the formed part and the coil prevents an electromagnetic field to be produced within the formed part in further steps of the process. In addition, because heat is produced in the formed part during the electromagnetic forming due to the electric current, electromagnetic method cannot be used for forming thin heat sensitive sheets. In the electromagnetic forming, using a large coil for a small sheet may cause the electrical energy discharged from the capacitors to go waste. In addition, electromagnetic method cannot be used for forming sheets made of two or more materials with different conductivities.

In the electrohydraulic forming process, if the forming is performed in multiple steps, the volume of the formed part may change. Therefore, it is required to adjust the amount of fluid between every two consecutive steps. In addition, after each step, the gas produced in that step due to evaporation of the fluid needs to be discharged. If the distance between electrodes is high or the conductivity of the fluid is low, a connection wire is used between the electrodes to cause the electric discharge in a low voltage. This process is time consuming. Under such circumstances, the connection wire needs to be reconnected after each step of a multiple step forming process. In the electrohydraulic forming method, the electrodes are gradually corroded and the distance between electrodes increases due to corrosion. Therefore, the electrodes require repeated adjustment.

In the electromagnetic forming method, the electrodes are consumed during the process and after multiple use the electrodes should be replaced with new electrodes. Corrosion of electrodes can gradually pollute the fluid and the electrical properties of the fluid such as conductivity and the pressure from the shock wave produced within the chamber may change due to pollution. Therefore, the fluid needs to be continuously filtrated or replaced. In electrohydraulic forming, the particles released in the fluid due to electrode corrosion can rapidly hit the formed part in next explosions and cause scratching and damaging to the formed part. In electrohydraulic forming method, the volume of fluid is an important parameter in the forming process and any change in the liquid volume may require a new die to be designed and made. In electrohydraulic forming with multiple steps, the fluid is evaporated in each step and the produced gas due to evaporation needs to be released and the fluid volume needs to be adjusted prior to next forming step. This can cause additional time spent on each forming step. The distance between the electrodes and the sheet is an important parameter in forming and adjustment of the distance is a hard and time consuming process. In electrohydraulic forming with multiple steps, the distance between the fixed electrodes and the sheet increases at each step of the process and as a result later steps of the forming process may require higher energy.

FIG. 1 illustrate a system for high-speed hydraulic forming of metal and non-metal sheets using electromagnetic fields, according to one implementation. In the system shown in FIG. 1, an electromagnetic field produced within a coil can create an eddy current and an opposite field in a plate with high conductivity placed on the coil. The repelling force between the two opposite electromagnetic fields can cause the high conductive plate to be pushed away from the coil. High-speed moving of the plate can be transferred via a piston to a fluid stored in a container. The high-speed movement can initiate a shock wave within the fluid. The produced shock wave is transferred to the sheet to be formed and the sheet takes the shape of the die which is evacuated, for example, by being placed in a vacuum chamber Referring again to FIG. 1, a flat coil 18 is connected to a pulse generator via wires 19 and 20. The coil 18 is placed inside an insulator 17. The insulator 17 is placed on a connector 32. The connector 32 connects the insulator 17 to a hydraulic jack 33. The hydraulic jack 33 can move vertically and carry the coil 18 and the insulator 17 up and down. The hydraulic jack 33 can also be fixed to prevent any movement of the coil 18.

A pressure chamber 28 is filled with fluid 8. The material sheet (metal or non-metal) 7 is placed on the fluid filled chamber 28. The sheet 7 is fastened tightly between the chamber 28 and a die 3. When the diode switch 22 is closed, the high voltage transformer 23 is connected to the capacitors 25 and a high electrical energy is stored in the capacitors 25. As the high voltage switch 21 is closed, the electric circuit consisting of capacitors 25 and the coil 18 is closed and the high voltage electricity stored in capacitors 25 is released in the coil 18. This connection causes a high current with damped oscillations passes through the coil 18. An electromagnetic field is produced in the coil 18 due to this current.

The electromagnetic field within coil 18 creates a time-varying eddy current in a plate 13 which is a high conductive plate. The time-varying eddy current in a conductive plate 13 cause creation of an electromagnetic field in the plate 13 which is opposite to the electromagnetic field in coil 18. The two opposite electromagnetic fields of plat 13 and coil 18 creates a strong repelling force towards each other. The repelling force pushes the plate 13 upward toward the sheet 7. A piston 30 is placed inside the pressure chamber 28, where the piston 30 can axially move in the fluid 8 filled inside the pressure chamber 28. The pressure on plate 13 is transferred to piston 30, placed inside the pressure chamber 28, and piston 30 moves upward toward sheet 7. High-speed upward movement of piston 30 creates a shock wave in fluid 8 and this shock wave pushes sheet 7 upward into the hollow shape inside die 3 (in vacuum condition) and the sheet 7 takes the shape of die 3. It is noted that the space between the sheet 7 and die 3 can be connected to a vacuum pump (not shown) via a port 6 and prior to the start of forming process, the air in this space is evacuated. As a result, the energy required for forming the sheet 7 can be reduced.

In order to prevent leakage of fluid 8 from a gap between the pressure chamber 28 and the sheet 7 during the forming process, an O-ring (or packing) 5 can be installed between the sheet 7 and the pressure chamber 28. In addition, an O-ring 10 can be installed between the piston 30 and the pressure chamber 28 to prevent fluid leakage from a gap between the pressure chamber 28 and piston 30. In addition, the entrance port of the fluid into the pressure chamber 28 can be equipped with a check valve to prevent backflow of the fluid from the pressure chamber 28.

Figure 2A:
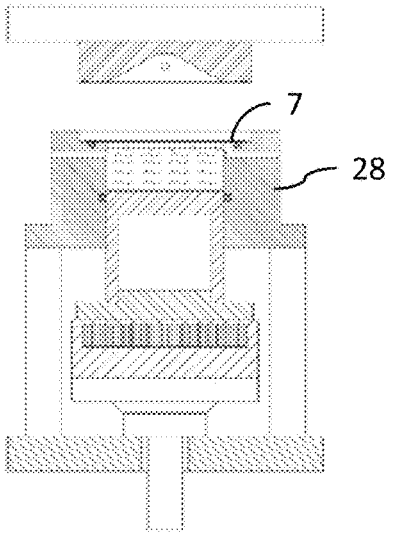
FIGS. 2A-2H illustrate multiple steps of the high-speed hydraulic forming of metal and non-metal sheets using electromagnetic fields, according to an implementation.
Figure 2B:
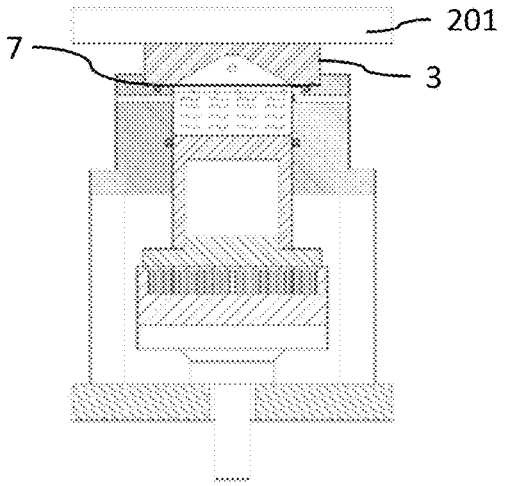
Figure 2C:
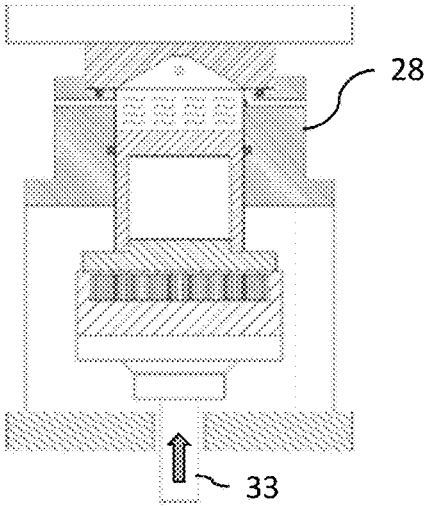

The process for high-speed hydraulic forming of metal and non-metal sheets using electromagnetic fields, as discussed with respect to FIG. 1 can be used for single step and multiple step forming. FIGS. 2A-2H illustrate multiple steps of the high-speed hydraulic forming of metal and non-metal sheets using electromagnetic fields, according to an implementation. As shown in FIG. 2A, the sheet 7 is placed on the pressure chamber 28. As seen in FIG. 2B, a press ram 201 connected to the die 3 presses the die 3 on the sheet 7. The pressure chamber 28 is filled with a specified volume of fluid and as shown in FIG. 2C. For example, a pump can be connected to the pressure chamber 28 to adjust the fluid volume. The hydraulic jack 33 is pushed up slightly such that the air inside the pressure chamber 28 is pushed out from the top port of the pressure chamber 28. As discussed with respect to FIG. 1, and shown in FIG. 2D, upon discharge of electrical current in coil 18, the piston 30 is rapidly pushed upward and as a result the fluid is pushed toward sheet 7. Upon completion of forming a piece and prior to the next forming process, the fluid 8, the piston 30 and the conductive plate 13 can be readjusted to their initial positions by an accumulator.

Figure 2D:
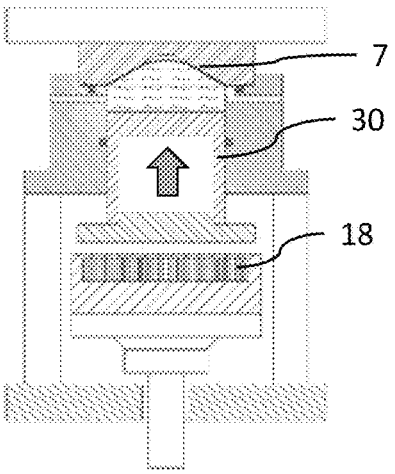
Figure 2E:
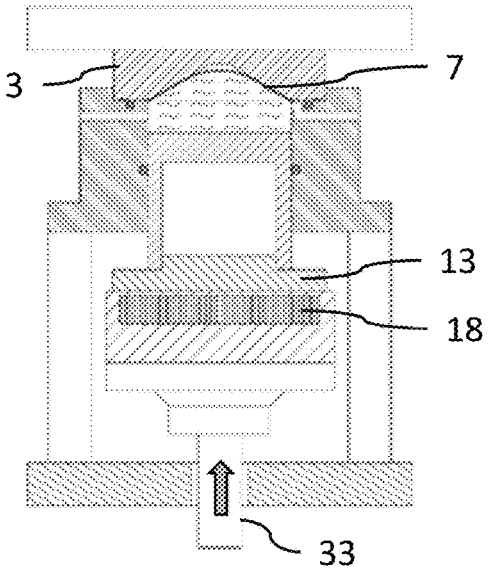
Figure 2F:
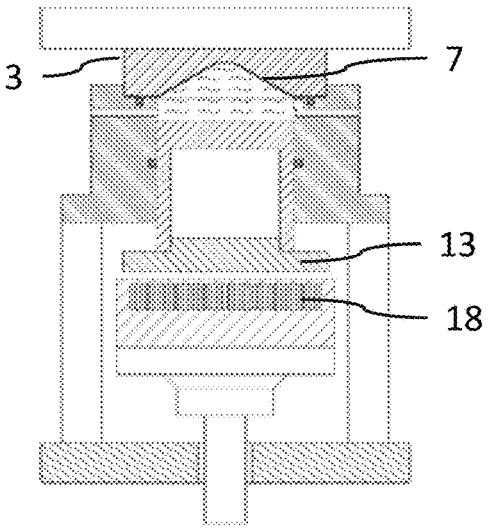

In some cases, the forming process may not be completed in one step and multiple steps may be needed. For example, as shown in FIGS. 2D and 2E, the plate 7 has not taken the complete shape of the hollow in die 3. In such cases, the hydraulic jack 33 is moved further up such that the high conductive plate 13 comes to contact with the coil 18 (shown in FIG. 2E). Upon adjustment of the plate 13, the capacitors 25 (shown in FIG. 1) are recharged and discharged into coil 18 again. As shown in FIG. 2F, the second discharge of electricity in coil 18 leads to a second step (e.g., a second shock wave) in forming process similar to the first step discussed with respect to FIG. 1. As shown in FIG. 2F, the sheet 7 has taken the shape of hollow in die 3. The forming process can be repeated multiple times until the desired form of sheet 7 is achieved.

Figure 2G:
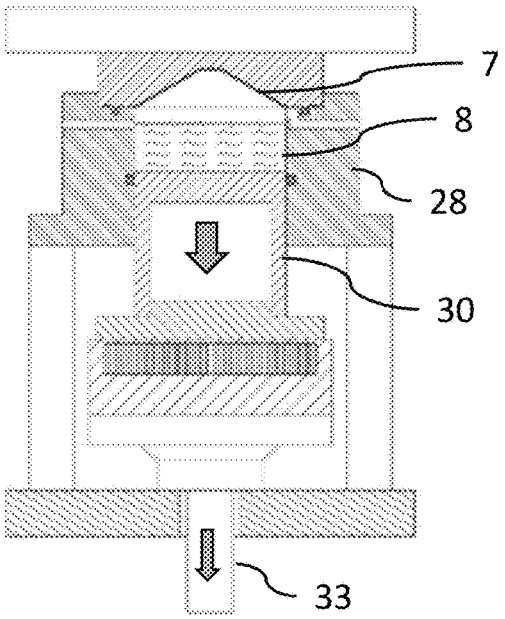
Figure 2H:
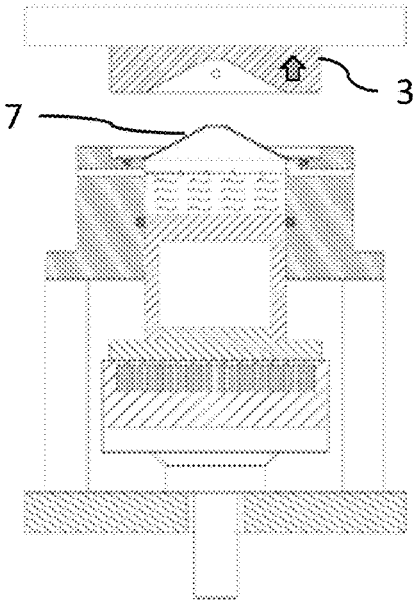

Upon completion of the forming process, as shown in FIG. 2G, the hydraulic jack 33 is moved downward and a valve 35 (shown in FIG. 1) is opened. As a result, air enters the pressure chamber 28 from the top port of the pressure chamber (shown as 34 and 40 in FIG. 1). The air pressure pushes the piston 30 downward and the air sits on top of the fluid 8 between fluid 8 and the formed sheet 7. Subsequently, as shown in FIG. 2H, the die 3 can be lifted and the formed sheet 7 can be removed from the system.

Various parameters can affect the efficiency of the forming process, as discussed. For example, the higher the conductivity level of plate 13, the stringer the repelling force between coil 18 and plate 13, and as a result the higher the efficiency of the forming process. The thickness of the plate 13 can be selected such that the plate 13 is neither too thin to change shape due to the pressure produced from a shock wave of repelling force, nor too thick to make it too heavy such that it resists the produced pressure. The dimensions of the high conductive plate 13 may need to be selected such that the plate 13 covers the whole area of the coil 18 to prevent waste of energy. The ratio of the diameter of piston 30 to the diameter of the high conductive plate 13 may need to be as small as possible to increase the produced pressure. The piston 30 may need to be light. The lower the weight of the piston 30, the less its resistance to the produced pressure.

Another important factor is the surface hardness of the piston 30 and of the inner walls of the pressure chamber 28. The surface hardness of the pressure chamber 28 may need to be higher than the surface hardness of piston 30. This can prevent corrosion of the inner walls of the pressure chamber 28, while the piston 30 may be corroded faster. For example, the pressure chamber 28 can be made from double polished standard fittings.

The hydraulic jack 33 is kept motionless during the forming process when the electricity is flowing in circuit 19-18-20 (the circuit between coil 18 and the capacitors 25). Any movement in the hydraulic jack 33 at this step may drastically reduce the efficiency of the forming process.

The viscosity of fluid 8 may be an important factor in the forming process. A thin fluid 8 can transfer the pressure from piston 30 to sheet 7 faster than a thick fluid 8. The volume of fluid 8 may also be an important parameter. In a single-step forming process, the volume of the fluid 8 can be equal the capacity of pressure chamber 28. However, in a multi-step forming process, the volume of fluid 8 can be less than the chamber 28 capacity. An optimum volume of fluid 8 can be determined and calculated.

A desired fluid 8, is a fluid with low compressibility to efficiently transfer pressure to sheet 7. For example, grease or thick oils may contain small amounts of air which if not removed prior to the forming process can cause a waste of energy for compression of (and heating) the air. The compressibility of fluid 8 and the amount of energy loss during the forming process depend on the amount of air in the fluid 8. Chemical properties of the fluid need to be such that amount of corrosion of the surface of piston 30 and inside of the pressure chamber 28 can be minimal.

As discussed with respect to FIG. 1, the pressure produced in the process, is transferred to sheet 7 via the high conductive plate 13 and piston 30. If the plate 13 and piston 30 are not tightly fastened together, the pressure may cause a collision between the plate 13 and piston 30 and this can cause energy loss. Therefore, the plate 13 and piston are tightly fastened together. In addition, the shape of plate 13 and piston 30 are designed such that the pressure is transferred from plate 13 to the piston 30 symmetrically. Lack of symmetric energy transfer can reduce the life of the system.

The amount of electrical energy discharged from capacitors 25 into the flat coil 18, affects the strength of the eddy current produced within the coil 18 and as a result affects the efficiency of the process. Moreover, the voltage of the electrical energy can directly affect the pressure applied to sheet 7 from fluid 8.

The electrical resistance of the flat coil 18 may be low. The lower the electrical resistance of coil 18, the higher the electric current flow within the coil 18 and the lower the heat produced in coil 18. The shape of piston 30 can be designed based on the desired shape of the formed part from sheet 7. For example, the piston 30 can be designed such that some parts of sheet 7 receive more or less pressure than other parts of the sheet 7.

The air inside the hollow of die 3 is removed such that a vacuum is created in the hollow. This can prevent energy loss, because the energy spend on compression of the air inside die 3 may be eliminated or reduced. The shape of pressure chamber 28 is designed such that the pressure can be transferred from piston 30 to a smaller area on sheet 7. This can help concentration of pressure for forming thick sheets 7.

Figure 3:
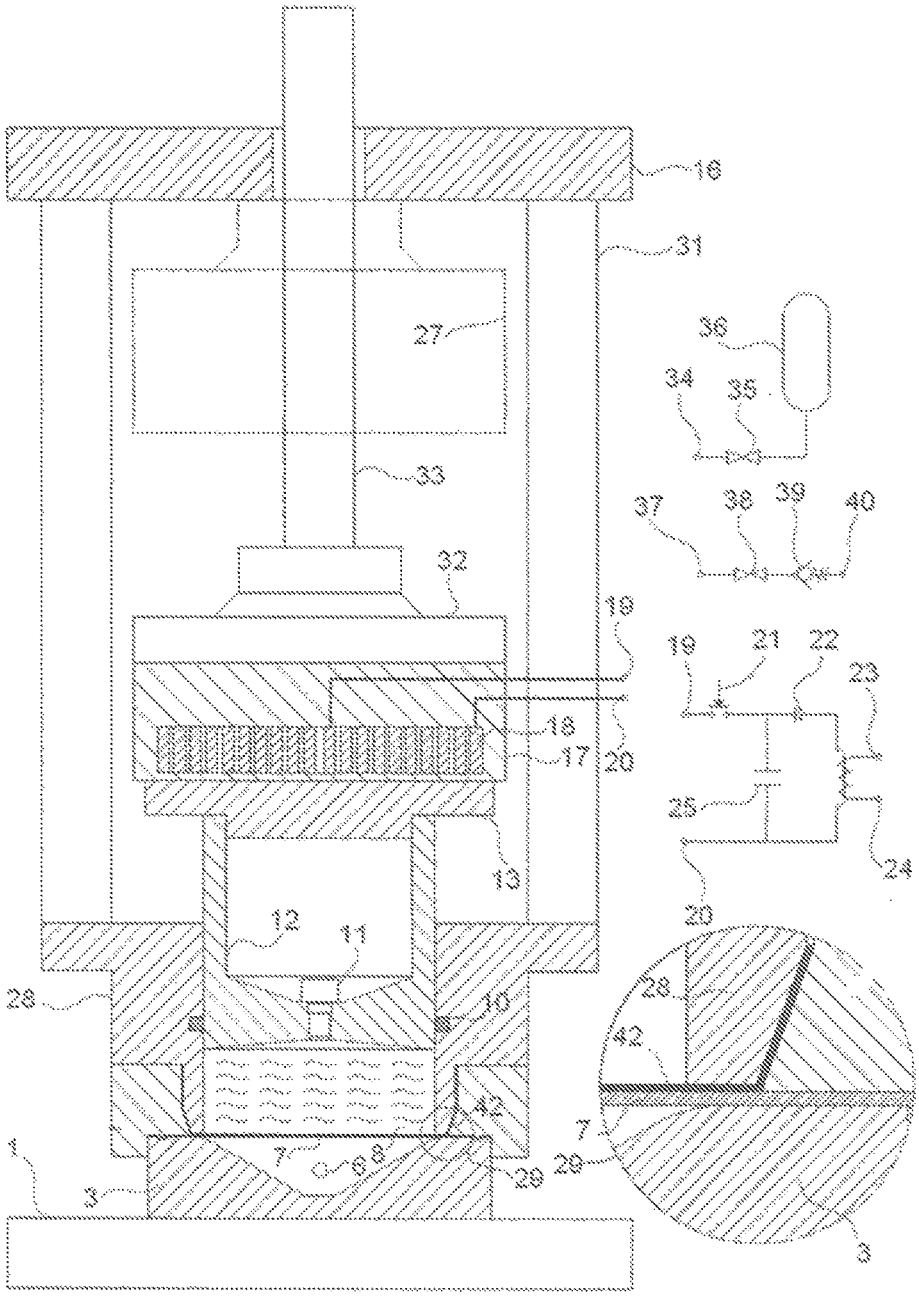
FIG. 3 illustrate a diagram of a system for high-speed hydraulic forming of metal and non-metal sheets using electromagnetic fields and a flexible rubber pad, according to one implementation.

FIG. 3 illustrate a diagram of a system for high-speed hydraulic forming of metal and non-metal sheets using electromagnetic fields and a flexible rubber pad, according to one implementation. The system of FIG. 3 is similar to the system of FIG. 1 except a rubber pad 42 is placed between the fluid 8 and sheet 7. Expanded area 29 shows the rubber pad 42 in more detail. The rubber pad 42 may prevent or reduce direct contact between the fluid 8 and sheet 7. The use of rubber pad 42 can have various advantages. Prevention of direct contact between sheet 7 and fluid 8 may prevent staining the sheet 7 with fluid 8. In cases where water is used as fluid 8, the rubber pad 42 can prevent corrosion of sheet 7 due to contact with water.

The rubber pad 42 prevents spillage of fluid 8 on sheet 7 and as a result the volume of fluid 8 can remain constant and may not reduce by each forming process. In the forming method of FIG. 3, using the rubber pad 42, the step of forming process described in FIG. 2C can be eliminated and the forming process can be performed faster than the process of FIG. 1. The step described in FIG. 2C includes slight upward push to the hydraulic jack 33 to remove the air inside the pressure chamber 28 by pushing the air out from the top port of the pressure chamber 28.

In the forming process by the system of FIG. 3, the pressure chamber 28 is filled with fluid 8. For example, in an initial setup the high conductive plate 13 and piston 12 can be removed, the pressure chamber is filled with fluid 8, and the piston 12 can be replaced. Upon replacing the piston 12, the piston is pressed down such that the air inside the piston can be discharged from an opening at the bottom of piston 12. A sealing screw 11 can be then fastened to prevent air from entering the piston. Next, the high conductive plate 13 is placed on top of the piston 12. For performing the forming process, the hydraulic jack 33 is pushed down such that the coil 18 comes in contact with the high conductive plate 13. The forming process is performed similar to the process explained with respect to FIG. 1.

Upon completion of a single step forming process, the press ram 16 and the hydraulic jack 33 can be moved upwards and the sheet 7 can be replaced for next forming process. However, for a multi-step forming process, as described with respect to FIG. 1, upon completion of each step, the hydraulic jack 33 can be slightly moved downward such that a gap between the high conductive plate 13 and coil 18 created in the last forming step is removed and the high conductive plate 13 and coil 18 come to contact again.

Figure 4:
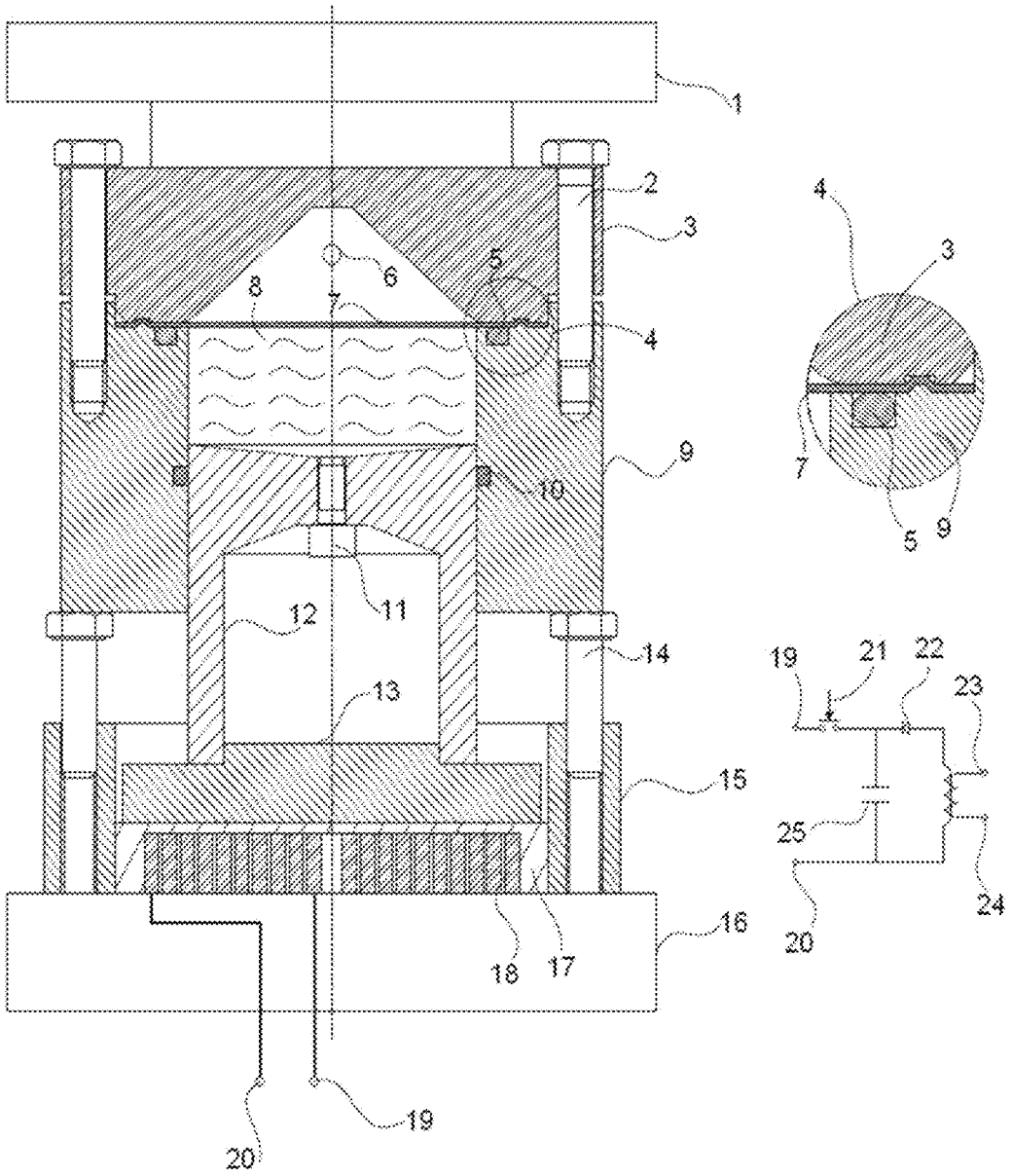
FIG. 4 illustrate a diagram of an exemplary implemented system for high-speed hydraulic forming of metal and non-metal sheets.

FIG. 4 illustrate a diagram of an exemplary implemented system for high-speed hydraulic forming of metal and non-metal sheets. In the diagram of FIG. 4 the screws 2 attach the die 3, the pressure chamber 9 and the sheet 7 together. In addition, the press ram 1 is used to keep together the combined die 3 and pressure chamber 9 and their other components with the flat coil 18. As the electric energy stored in capacitors 25 is discharged in flat coil 18, a high electric current flows in the coil 18 and the electromagnetic field produced within the coil 18 due to the electricity pushes the high conductive plate 13 up. The force produced from the high-speed movement of plate 13 is transferred to fluid 8 via piston 12. The fluid 8 which is a non-compressible fluid transfers the force to sheet 7 and the sheet 7 is pushed towards die 3 and takes the shape of die 3, as a result of the force. The circumferences of die 3 and the pressure chamber 9 can be grooved such that the grooves prevent sheet 7 from being radially displaced during the forming process.

The forming process of sheet 7 in the system of FIG. 4 can be performed in two stages namely preparation stage and forming stage. At the preparation stage, the sheet 7 is placed between the die 3 and the pressure chamber 9 and the screws 2 are fastened to keep the three together. The die 3 is then turned upside down and the piston 12 is removed from inside of the pressure chamber 9. The inside of the pressure chamber 9 is filled with a predetermined volume of fluid 8 and the piston 12 is replaced inside the fluid. The piston 12 is pushed up such that the fluid is moved upward and any air trapped in the pressure chamber 9 (or in fluid 8) is removed. The piston 12 can be pushed up manually or using a press device such as, for example the hydraulic jack 33 (shown in FIG. 1).

Upon removal of the air from fluid 8, the screw 11 is fastened the bottom of piston 12 is inclined to facilitate removal of the air. Next, the high conductive plate 13 is placed above the piston 12. At this point, the device can be turned upside up such that the plate 13 is positioned on the flat coil 18. At this step height of the bases 15 of the system is adjusted using the screws 14. The system is ready for the second stage, the forming process. It is noted that upon each opening and closing of the die 3 air may enter the pressure chamber 9 and the air needs to be removed before further actions. In addition, O-rings (or packing) 5 are used to prevent leakage of the fluid 8. The second stage of forming process is the same implementation described above.

Figure 5:
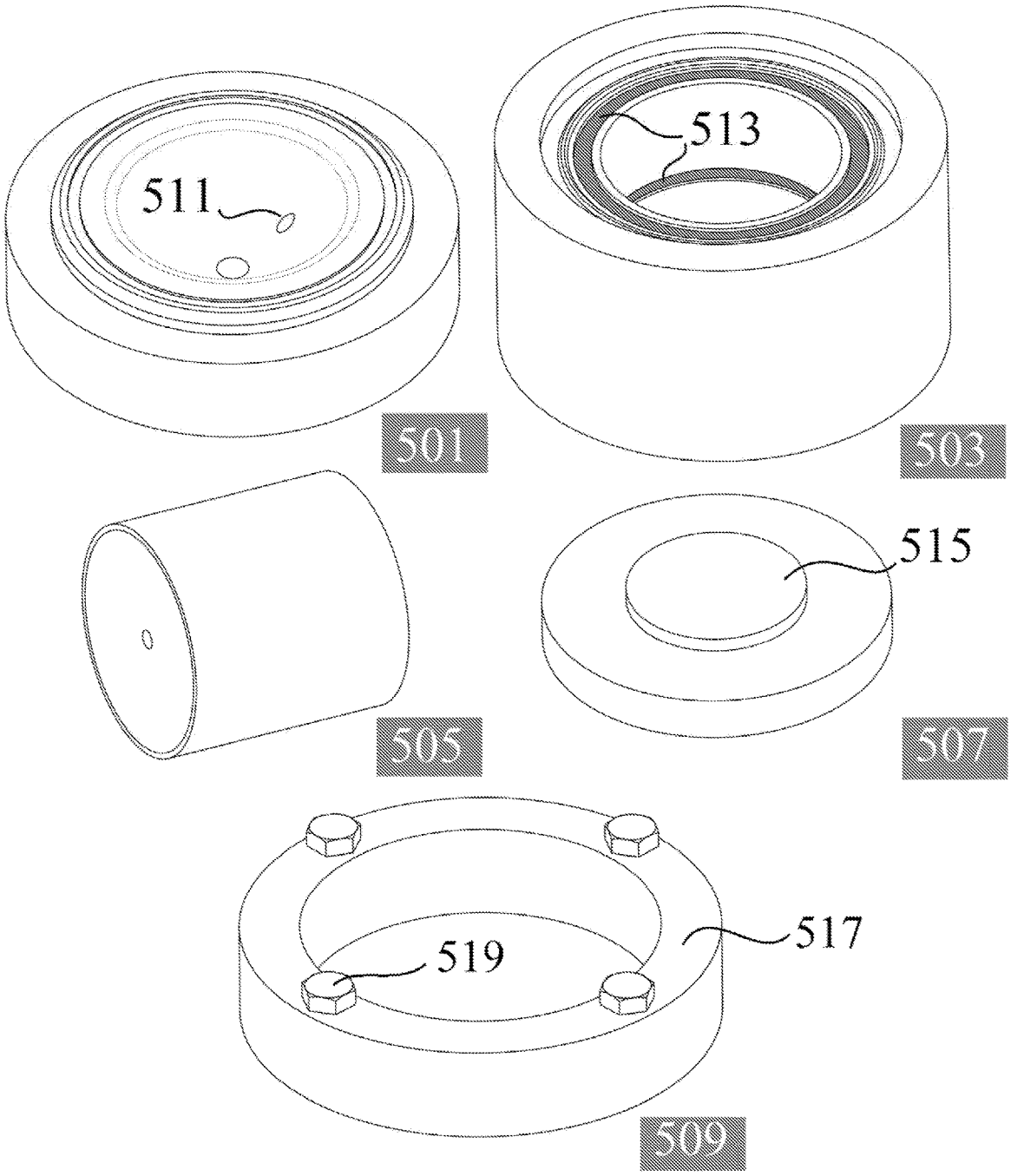
FIG. 5 illustrates sample components of the system used for high-speed hydraulic forming of metal and non-metal sheets, according to one implementation.

FIG. 5 illustrates sample components of the system used for high-speed hydraulic forming of metal and non-metal sheets, according to one implementation. The piece 501 is a cone shaped die (similar to die 3 in FIG. 1). A port 511 on the side of the cone facilitates removal of air from the die cavity. The die 501 can be made from steel. The piece 503 is a pressure chamber (similar to pressure chamber 28 of FIG. 1). An O-ring 513 is placed in the inner wall of the pressure chamber 503 to prevent leakage of fluid 8 from the pressure chamber into the die 501. The pressure chamber 503 can be made from steel.

The piece 505 is a piston (similar to piston 30 of FIG. 1). The piston can be made from a hard chrome plated rod. The bottom of piston 505 can be inclined to facilitate air removal from the pressure chamber 503 during the forming process. The piece 507 is a high conductive plate (similar to the high conductive plate 13 of FIG. 1). The plate 507 can be made from aluminum. The raise platform 515 at the center of plate 13 is fixed on top of the piston 505 when the forming system is assembled. The piece 509 is an adjustable base of the system (similar to base 15 of FIG. 4). The main base 517 can be made from polyethylene material such that it is not affected by the electromagnetic field. Screws 519 are installed on the base 517 for adjusting the height.

Figure 6:
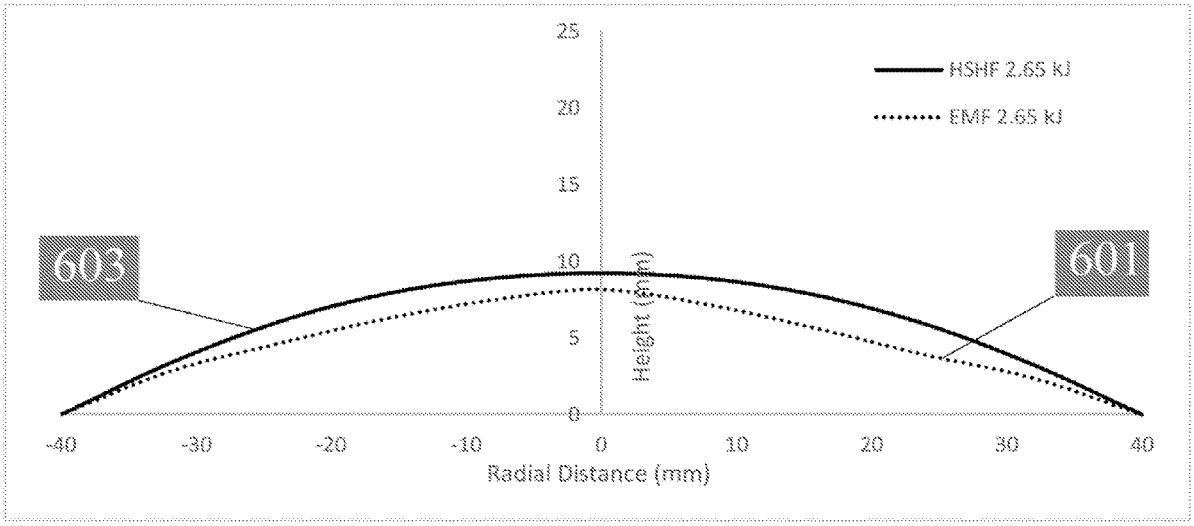
FIG. 6 illustrates shape comparison of two parts formed by the system for high-speed hydraulic forming of metal and non-metal sheets, according to one implementation.

FIG. 6 illustrates shape comparison of two parts formed by the system for high-speed hydraulic forming of metal and non-metal sheets, according to one implementation. The piece 601 is a steel piece formed using the electromagnetic forming method. Due to the low conductivity of the initial steel sheet used in forming process, a driver sheet is required. In the sample forming process of piece 601 an aluminum driver sheet with a 0.6 mm thickness is used. The driver sheet cannot be reused and is considered waste product after completion of the forming process. The piece 603 is a steel piece (similar to piece 601) formed using the disclosed system of the present application. In comparison with piece 601, piece 603 has a smoother surface, and has taken a closed shape to the die. Hydraulic oil has been used as fluid 8 in the forming process of piece 603 and no driver sheet is used. Both pieces 601 and 603 have been formed by discharging 2.65 Kilojoules (KJ) energy into the flat coil.

Figure 7:
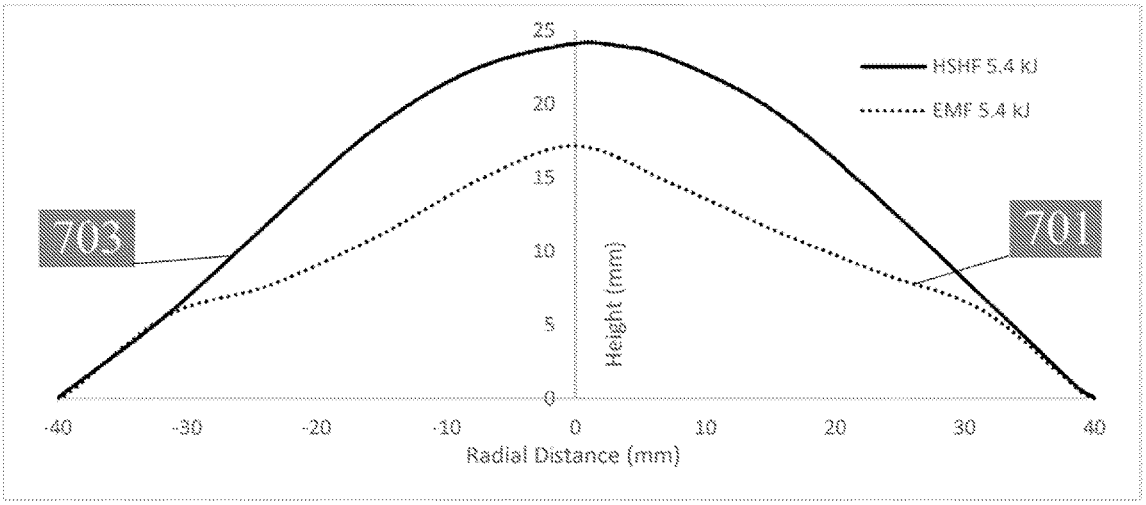
FIG. 7 illustrates shape comparison of two high conductive parts formed by the system for high-speed hydraulic forming of metal and non-metal sheets, according to one implementation.

FIG. 7 illustrates shape comparison of two high conductive parts formed by the system for high-speed hydraulic forming of metal and non-metal sheets, according to one implementation. The piece 701 is an aluminum piece with a 0.6 mm thickness and having high conductivity, formed using the electromagnetic forming method. Due to the high conductivity of the initial aluminum sheet used in forming process, no driver sheet is required for process of the instant application. The piece 703 is an aluminum piece (similar to piece 701) formed using the disclosed system of the present application. In comparison with piece 701, piece 703 has a smoother surface, and has taken a closed shape to the die . . . Both pieces 701 and 703 have been formed by discharging 5.4kJ energy into the flat coil.

Figure 8:
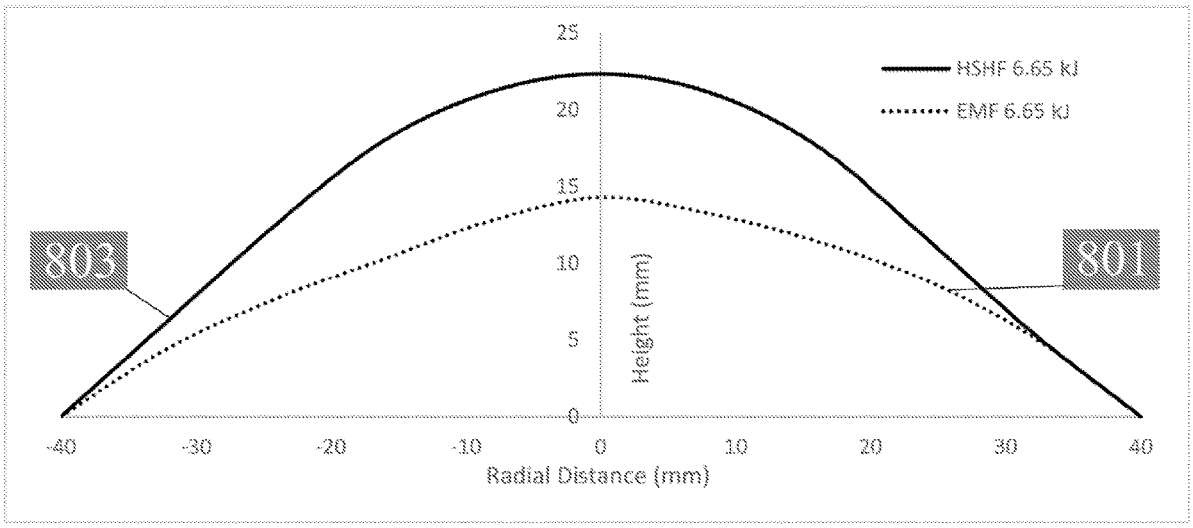
FIG. 8 illustrates shape comparison of two parts formed by electromagnetic forming method and the system for high-speed hydraulic forming of metal and non-metal sheets.

FIG. 8 illustrates shape comparison of two parts formed by electromagnetic forming method and the system and method for high-speed hydraulic forming of metal and non-metal sheets. The piece 801 is formed using the electromagnetic forming method from a steel sheet with 0.5 millimeters (mm) thickness. A driver aluminum sheet with 0.6 mm thickness is used in the process, due to low conductivity of steel. The piece 801 is formed by discharging 6.65 KJ energy into the flat coil. The piece 803 is a steel piece with 0.5 mm thickness (similar to piece 801) formed using the disclosed system of the present application using the same discharged energy as piece 801 (6.65 KJ). in comparison with piece 801, piece 803 has a higher risen form, because no driver sheet is used in forming piece 803 and energy loss was smaller.

Figure 9:
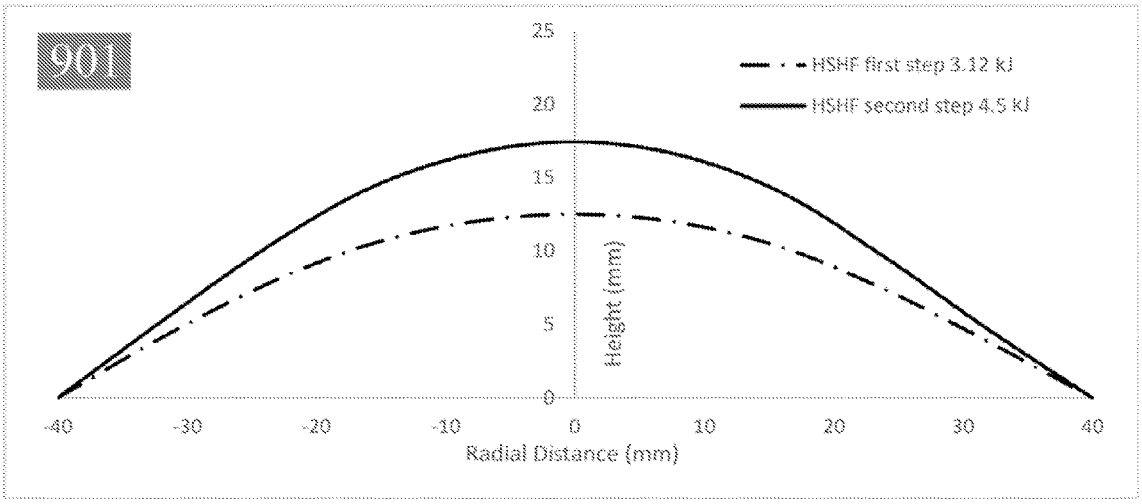
FIG. 9 illustrates a piece formed by the system for high-speed hydraulic forming of metal and non-metal sheets, according to one implementation.

FIG. 9 illustrates a piece formed by the system and method for high-speed hydraulic forming of metal and non-metal sheets, according to one implementation. The piece 901 is a steel piece made from a steel sheet with 0.5 mm thickness using the disclosed system of the present application. The piece 901 is formed in two steps. The method of forming using the disclosed system in multiple steps is suitable for deep hollow pieces, because repeated forming step can provide the required depth in the piece. The discharged energy used for forming piece 901 are 3.12 KJ and 4.5 KJ for the first and second forming steps respectively. As previously described, in multi-step forming, upon completion of the first step, the coil 18 (of FIG. 4), which has been distanced from the conductive plate 17 during the first step, is adjusted using the screws 14 in base 15. Once the coil 18 and plate 17 are adjusted, the second step of forming process is performed such that the required depth in piece 903 can be achieved. If the required depth is not achieved in second step, the forming steps can be repeated until the required depth is achieved.

The described system and method for high-speed hydraulic forming of metal and non-metal sheets provides various advantages over known methods. For example, conductivity of the initial sheet is a requirement in the electromagnetic forming methods, while the described system and method can be applied on conductive and non-conductive material. This is because the pressure required for forming of the sheet is transferred to the sheet via a liquid.

In electromagnetic forming method, an auxiliary sheet has to be used for forming a non-conductive or low conductive sheet. Using the auxiliary sheet reduces efficiency of forming process by energy loss due to forming of the auxiliary sheet. However, in the described method and system the produced energy is not wasted on an auxiliary sheet and is applied on the sheet which is being formed. As a result, the forming can be performed with lower energy than other methods. In addition, the cost of the described method and system is lower than the electromagnetic method because there is no cost for the not-reusable auxiliary sheet, while the fluid used in the described method and system is reusable.

In the described system and method, due to flexibility of the fluid the forming pressure is applied to the sheet more uniformly compared with the electromagnetic forming method. As a result, the formed piece is more uniform as well. The described system and method provides multi-step forming of sheets in which the forming steps can provide an accurate forming and can be performed without opening the die. While, for example, in the electrohydraulic forming method the distance between electrodes increases after each forming and the electrodes distance should be adjusted repeatedly. Also as the distance between electrodes increases, a wire can be attached between them where a long time may be spent on attaching the wire to the electrodes. It is noted that methods such as electromagnetic forming method do not provide multi-step forming.

In electromagnetic forming, if a large coil is used for forming a small piece, a large part of the produced electric energy gets wasted, because the whole energy cannot be concentrated on the sheet, while in the described system and method it is possible to concentrate the produced energy on the sheet by using a large conducive plate and small piston. Similarly, in the described system and method the pressure can be concentrated from a small flat coil onto a large area of the sheet. For example, large thin sheets can be formed using a small coil with an area several times smaller than the sheet.

In electromagnetic forming method, forming thin sheets or heat sensitive sheets increased temperature during the process due to the induced eddy current may damage the sheet. For example, the sheet may melt or get distorted. For example, forming aluminum blister packs for packaging small consumer goods using electromagnetic forming may melt or distort the aluminum, while in the described system and method use of fluid can adjust the temperature. Other than transferring the pressure, the fluid can act as a cooling agent during the forming process.

The electromagnetic forming method cannot be used for forming parts of the piece in locations distant from the coil. For example, the electromagnetic forming method cannot be used for expansion forming of narrow pipes. This is because due to narrow diameter of the pipe, installing a coil inside the pipe may not be possible. However, in the described system and method the fluid can easily transfer the pressure to the inside part of the narrow pipe and form parts of the piece which are distant from the coil.

In electromagnetic forming method, the flat coil may have to be changed several times to form a complex and detailed piece. However, in the described system and method, forming complex and detailed pieces can be performed with one flat coil without the need for changing the coil.

In electrohydraulic forming method, electrodes are damaged due to corrosion and they need to be replaced with new electrodes periodically. This increases the process cost. The described system and method does not cause such problem because of not using electrodes.

In electrohydraulic forming method, electrode corrosion gradually pollutes the fluid. The electric properties of a polluted fluid such as, for example, conductivity, combustibility and the produced pressure inside the pressure chamber, may change and these changes can affect the forming process. The polluted fluid needs to be either filtered or replaced. The described system and method does not cause such problem because of not using electrodes and external polluters do not come in contact with the fluid.

In electrohydraulic forming method, electrode corrosion may spread particles from the electrodes inside the fluid. These particles, in addition to polluting the fluid, can cause damage to the sheet and the formed piece. For example, the pressure in the fluid can cause the particles to hit the inner side of the formed piece and damage the piece due to the impact. The described system and method does not cause such problem because of not using electrodes and external polluters do not come in contact with the fluid.

In the electrohydraulic forming method, the volume of the fluid is an important parameter of the forming process. If the fluid volume changes, the chamber filled with the fluid may need to be redesigned. The described system and method does not suffer from such problems because the fluid volume can be controlled by adjusting the piston.

In the multi-step electrohydraulic forming method, the fluid is gradually evaporated at each step of the forming process and there is a need to remove the vapors and adjust the fluid volume repeatedly. This can increase the time spent on forming process. In the described system and method the fluid volume remains unchanged throughout the forming process and the multi-step forming process can be performed rapidly without a need for fluid replacement or fluid volume adjustment.

In the electrohydraulic forming method, the distance between electrodes is an important parameter in determining the optimal efficiency of the process. Determining and adjusting the optimal distance between electrodes may need several trial and error experiments. The described system and method does not require such calculations because of not using electrodes.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. in addition, in the foregoing Detailed Description, it can be seen that various features are grouped together in various implementations for the purpose of streamlining the disclosure. This method of disclosure is not to be interpreted as reflecting an intention that the claimed implementations require more features than are expressly recited in each claim. Rather, as the following claims reflect, inventive subject matter lies in less than all features of a single disclosed implementation. Thus the following claims are hereby incorporated into the Detailed Description, with each claim standing on its own as a separately claimed subject matter.

What is claimed is:

1. A system for high-speed hydraulic forming of sheets using an electromagnetic field, the system comprising:

a coil connected to a power generator configured to produce electricity and transfer the electricity to the coil thereby creating a first electromagnetic field in the coil;

a conductive plate placed on the coil such that the first electromagnetic field causes creating of a second electromagnetic field in the conductive plate, the second electromagnetic field being in a direction opposite to the first electromagnetic field thereby creating a force pushing the conductive plate away from the coil;

a pressure chamber filled with a fluid and placed on the conductive plate;

a piston placed inside the pressure chamber and configured to transfer the force to the fluid, the fluid being in contact with the piston on a first side of the fluid;

a sheet placed on the pressure chamber on a second side of the fluid, the fluid being configured to receive the force from the piston and transfer the force to the sheet; and a die placed on the sheet, wherein the force transferred to the sheet from the fluid causes the sheet to take a shape of the die.

2. The system of claim 1, wherein the die includes a port coupled to a vacuum pump configured to remove air inside the die.

3. The system of claim 2, wherein the piston is configured to axially move in the pressure chamber toward the fluid.

4. The system of claim 3, wherein the pressure chamber is connected to a pump such that the pump adjusts a volume of the fluid in the pressure chamber.

5. The system of claim 4, wherein the pressure chamber include a port configured to remove air inside the pressure chamber.

6. The system of claim 5, further comprising:

a rubber plate placed between the fluid and the sheet; and an O-ring or packing placed between the piston and the pressure chamber, wherein the O-ring or packing is configured to prevent fluid leakage from a gap between the pressure chamber and the piston.

7. The system of claim 5, further comprising:

a rubber plate placed between the fluid and the sheet; and an O-ring or packing placed between the pressure chamber and the sheet, wherein the O-ring or packing is configured to prevent fluid leakage from a gap between the pressure chamber and the sheet.

8. The system of claim 1, wherein a circumference of the pressure chamber and a circumference of the die are grooved to prevent radial displacement of the sheet.

9. The system of claim 1, wherein the die is held in place by a press ram.

10. The system of claim 1, wherein the fluid is water or oil.

11. The system of claim 1, wherein the conductive plate is a thick plate made from copper or aluminum.

12. The system of claim 1, wherein an entrance port of the pressure chamber has a check valve to prevent backflow of the fluid.

13. The system of claim 1, further comprising an accumulator for readjusting the fluid, the piston and the conductive plate.

14. A method for high-speed hydraulic forming of a material sheet using an electromagnetic field, the method comprising:

filling a pressure chamber with a fluid;

placing a material sheet on the pressure chamber;

placing a piston inside the pressure chamber, the piston being configured to axially move in the pressure chamber;

placing a conductive plate in contact with the piston on a coil;

placing a die on the material sheet;

pressing the die to the material sheet using a press;

removing air from the pressure chamber by moving the fluid and the piston upward using a hydraulic jack; and connecting the coil to a power generator configured to produce electric current and transfer the electric current to the coil thereby creating a first electromagnetic field in the coil such that the first electromagnetic field causes a second electromagnetic field in the conductive plate, wherein:

the second electromagnetic field is in a direction opposite to the first electromagnetic field creating a repelling force there between, the repelling force is transferred by the piston to the fluid and from the fluid to the material sheet, and the repelling force transferred to the material sheet from the fluid causes the material sheet to take a shape of the die.

15. The method of claim 14, further comprising repeatedly adjusting the conductive plate on the coil and the piston on the conductive plate and discharging the electric current produced by the power generator in the coil, until the material sheet takes a complete shape of the die.

16. The method of claim 14, wherein the material sheet is a conductive sheet, a non-conductive sheet, or a combination thereof.

17. A system for high-speed hydraulic forming of a material sheet using an electromagnetic field, the system comprising:

a coil connected to a power generator configured to produce electric current and transfer the electric current to the coil thereby creating a first electromagnetic field in the coil;

a conductive plate placed on the coil such that the first electromagnetic field causes creating of a second electromagnetic field in the conductive plate, the second electromagnetic field being in a direction opposite to the first electromagnetic field thereby creating a force pushing the conductive plate away from the coil;

a pressure chamber filled with a fluid and placed on the conductive plate;

a piston placed inside the pressure chamber and in contact with a first side of the fluid and configured to receive the force from the conductive plate and move away from the coil and transfer the force to the fluid;

a material sheet placed on the pressure chamber on a second side of the fluid, the fluid being configured to receive the force from the piston and transfer the force to the material sheet;

a rubber pad placed between the fluid in the pressure chamber and the material sheet to prevent contact between the fluid and the material sheet, wherein the piston transfers the force to the fluid in the pressure chamber, and the fluid transfers the pressure force to the rubber pad which in turn transfers the force to the material sheet; and a die placed on the sheet, wherein the force transferred to the sheet from the fluid causes the sheet to take a shape of the die.

18. The system of claim 17, wherein the conductive plate is a thick plate made from a highly conductive metal such as copper or aluminum.

19. The system of claim 17, wherein the pressure chamber has a check valve at fluid entrance to prevent backflow of the fluid.

20. The system of claim 17, further comprising an accumulator for readjusting the fluid, the piston and the conductive plate.

* * * * *